US011644051B2

(12) United States Patent
Kanazawa et al.

(10) Patent No.: US 11,644,051 B2
(45) Date of Patent: May 9, 2023

(54) CYLINDER DEVICE

(71) Applicant: FUJIKURA COMPOSITES Inc., Tokyo (JP)

(72) Inventors: Osamu Kanazawa, Saitama (JP); Kenzo Miyamori, Saitama (JP)

(73) Assignee: FUJIKURA COMPOSITES INC., Tokyo (JP)

( * ) Notice: Subject to any disclaimer, the term of this patent is extended or adjusted under 35 U.S.C. 154(b) by 64 days.

(21) Appl. No.: 17/299,834

(22) PCT Filed: Dec. 3, 2019

(86) PCT No.: PCT/JP2019/047152

§ 371 (c)(1),
(2) Date: Jun. 4, 2021

(87) PCT Pub. No.: WO2020/116421

PCT Pub. Date: Jun. 11, 2020

(65) Prior Publication Data

US 2022/0025911 A1 Jan. 27, 2022
US 2023/0045779 A9 Feb. 9, 2023

(30) Foreign Application Priority Data

Dec. 5, 2018 (JP) ..... JP2018-227980

(51) Int. Cl.
*F15B 15/06* (2006.01)
*F15B 15/14* (2006.01)
(Continued)

(52) U.S. Cl.
CPC ..... *F15B 15/063* (2013.01); *F15B 15/1423* (2013.01); *F01D 1/34* (2013.01);
(Continued)

(58) Field of Classification Search
CPC ..... F15B 15/063; F15B 15/00; F15B 15/02; F15B 15/1423; F15B 15/1471; F15B 15/149
See application file for complete search history.

(56) References Cited

U.S. PATENT DOCUMENTS 1,846,817 A * 2/1932 Smith, Jr. ..... E21B 6/08 173/105
2,406,482 A * 8/1946 Tucker ..... B23Q 5/06 60/377
(Continued)

FOREIGN PATENT DOCUMENTS

JP 1963-018008 B1 9/1963
JP U1974-115530 U 10/1974
(Continued)

OTHER PUBLICATIONS

International Search Report for PCT/JP2019/047152 dated Feb. 18, 2020.

*Primary Examiner* — Dustin T Nguyen
(74) *Attorney, Agent, or Firm* — McCormick, Paulding & Huber PLLC

(57) ABSTRACT

Provided is a cylinder device capable of preventing rotation unevenness while reducing power consumption and achieving compactification in particular. The present invention is to provide a cylinder device including a cylinder body and a shaft member supported in the cylinder body, the cylinder body being provided with a rotation port that communicates with an outer circumferential surface around the shaft member and rotates the shaft member based on a supply and discharge of a fluid. Thus, it is possible to prevent rotation unevenness while reducing power consumption and achieving compactification.

3 Claims, 5 Drawing Sheets

(51) Int. Cl.
*F15B 15/02* (2006.01)
*F01D 1/34* (2006.01)
*F03B 1/00* (2006.01)

(52) U.S. Cl.
CPC ..... *F03B 1/00* (2013.01); *F15B 15/02* (2013.01); *F15B 15/149* (2013.01); *F15B 15/1471* (2013.01)

(56) References Cited

U.S. PATENT DOCUMENTS 2,459,902 A * 1/1949 Tucker ..... B23Q 5/26 83/639.1
2,893,210 A * 7/1959 Muszynski ..... F15B 15/063 92/2
2,955,579 A * 10/1960 Block ..... F15B 15/063 92/33
3,108,781 A * 10/1963 Saffir ..... A61C 1/181 433/80
5,367,943 A 11/1994 Stoll et al.
5,577,433 A 11/1996 Henry
5,634,392 A * 6/1997 Najork ..... F15B 15/063 92/121
6,098,517 A * 8/2000 Thorwart ..... B25J 9/14 92/121
7,311,036 B2 12/2007 Uchino
9,957,831 B2 * 5/2018 Soman ..... F15B 15/12

FOREIGN PATENT DOCUMENTS

JP 2011-069384 A 4/2011
JP 2017-009068 A 1/2017
JP 2017-133593 A 8/2017

* cited by examiner

CYLINDER DEVICE

CROSS-REFERENCE TO RELATED APPLICATIONS

This application is a National Stage application of International Patent Application No. PCT/JP2019/047152 filed on Dec. 3, 2019, which claims priority to Japanese Patent Application No. JP2018-227980 filed on Dec. 5, 2018, each of which is hereby incorporated by reference in its entirety.

TECHNICAL FIELD OF THE INVENTION

The present invention relates to a cylinder device including a rotation mechanism.

BACKGROUND OF THE INVENTION

The following Patent Literatures disclose cylinder devices including a mechanism configured to rotate a shaft member housed in a cylinder body.

Japanese Patent Laid-Open No. 2011-69384 discloses a rotary drive motor (brushless DC motor) configured to rotate a shaft member.

In Japanese Patent Laid-Open No. 2017-133593, a rotation drive portion is provided to rotate a shaft member at a predetermined angle. The rotation drive portion includes a rotary motor such as a stepping motor or a servo motor.

In Japanese Patent Laid-Open No. 2017-9068, a rotation drive portion is attached to a shaft member. The rotation drive portion includes a rotor and a stator surrounding a periphery of the rotor. A magnet is disposed on the rotor, and a coil is disposed on the stator. The shaft member is rotationally driven by an electromagnetic action.

SUMMARY OF THE INVENTION

However, there are problems that power consumption is increased and compactification cannot be appropriately achieved in the conventional configuration in which the shaft member is rotated by a motor or the like. In other words, heat is generated by use of the motor, and thus power consumption easily increases. Further, since the shaft member is mechanically rotated, a rotation mechanism becomes complicated, and compactification cannot be appropriately achieved. In addition, rotation unevenness is required to be prevented.

The present invention has been made in view of the above circumstances, and has an object to provide a cylinder device capable of preventing rotation unevenness while reducing power consumption and achieving compactification.

The present invention is to provide a cylinder device including: a cylinder body; and a shaft member supported in the cylinder body, the cylinder body being provided with a rotation port that communicates with an outer circumferential surface around the shaft member and rotates the shaft member based on a supply and discharge of a fluid.

In the present invention, preferably, the shaft member includes a rotating portion in which recessed parts and projecting parts are alternately continuous with each other along the outer circumferential surface, and the rotation port communicates with the rotating portion.

In the present invention, the shaft member is preferably supported to be capable of stroke.

In the present invention, preferably, the shaft member includes a rotating portion on the outer circumferential surface in a middle in the shaft direction, and stroke ports are provided in the cylinder body on a front side and a rear side of the rotating portion to stroke the shaft member by the supply and discharge of the fluid, the rotation port communicating with the rotating portion being provided between the stroke ports.

In the present invention, the rotation port is preferably formed to be plural in number.

In the present invention, the shaft member preferably includes a fluid bearing, the shaft member being supported in a state of floating in the cylinder body.

According to the cylinder device of the present invention, it is possible to prevent rotation unevenness while reducing power consumption and achieving compactification.

DETAILED DESCRIPTION

An Embodiment (hereinafter, abbreviated as "embodiment") of the present invention will be described in detail below.

Figure 1:
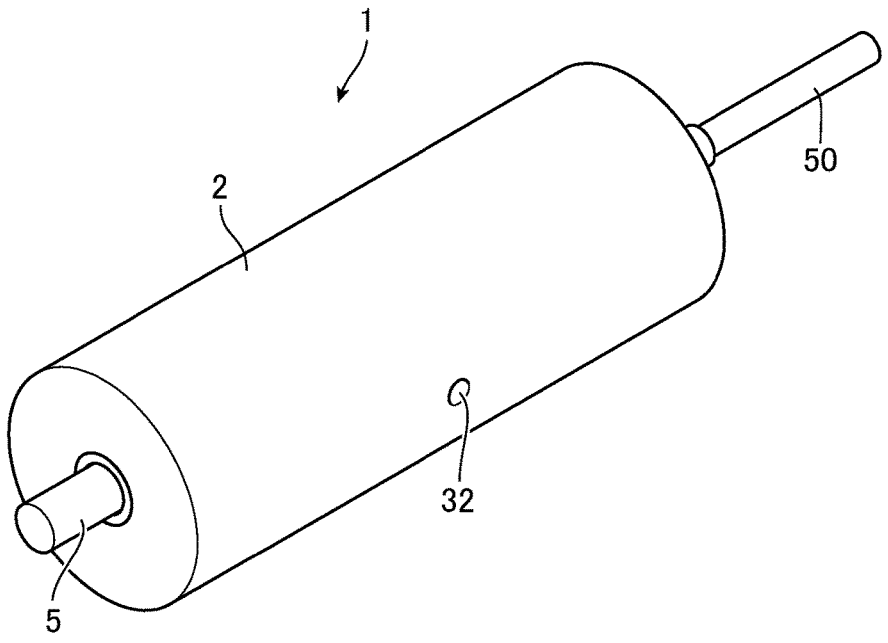
FIG. 1 is an exterior perspective view of a cylinder device according to an embodiment.
Figure 2:
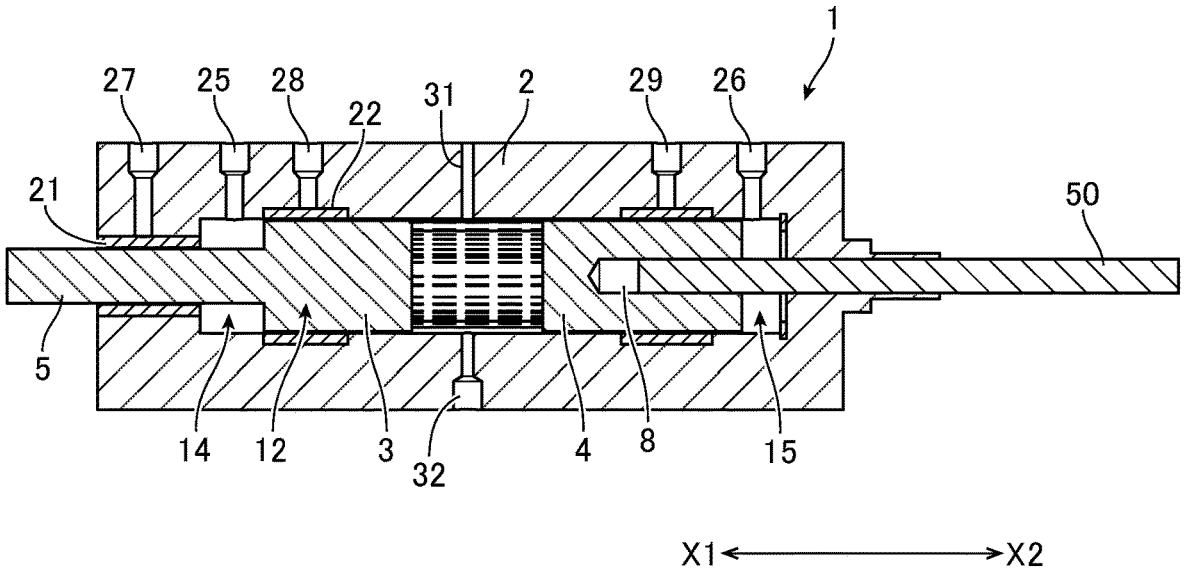
FIG. 2 is a cross-sectional view of the cylinder device according to the present embodiment taken along a shaft direction.

A cylinder device 1 shown in FIGS. 1 and 2, and the like includes a cylinder body 2 and a shaft member 3 supported by the cylinder body 2.

In the present embodiment, the shaft member 3 is rotatably supported. On the other hand, a stroke of the shaft member 3 is arbitrary. In other words, the cylinder device 1 of the present embodiment may be configured to enable only rotation of the shaft member 3, or may be configured to enable both rotation and stroke of the shaft member 3. However, a description will be made below with respect to the cylinder device 1 which allows the shaft member 3 to be stroked in a shaft direction while rotating.

Figure 4:
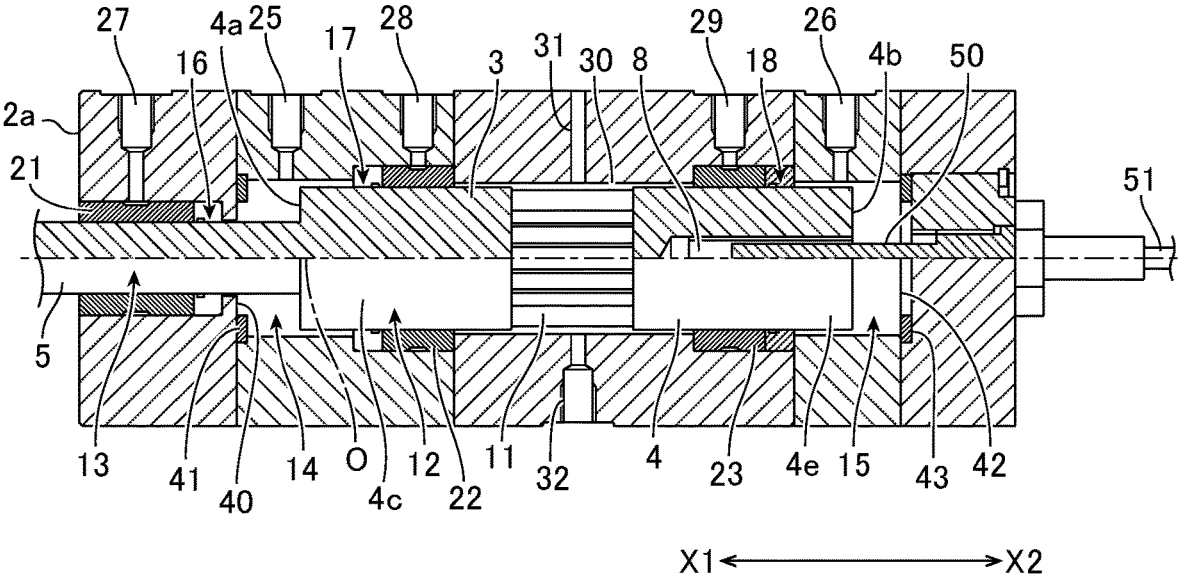
FIG. 4 is a partially enlarged cross-sectional view of the cylinder device shown in FIG. 2.

The term "rotation" means that the shaft member 3 rotates about a shaft center O which is the center of rotation (see FIG. 4). The term "stroke" means that the shaft member 3 moves in a shaft direction (X1-X2 direction). The X1 direction indicates a front side of the cylinder device 1, and the X2 direction indicates a rear side of the cylinder device 1.

Figure 3:
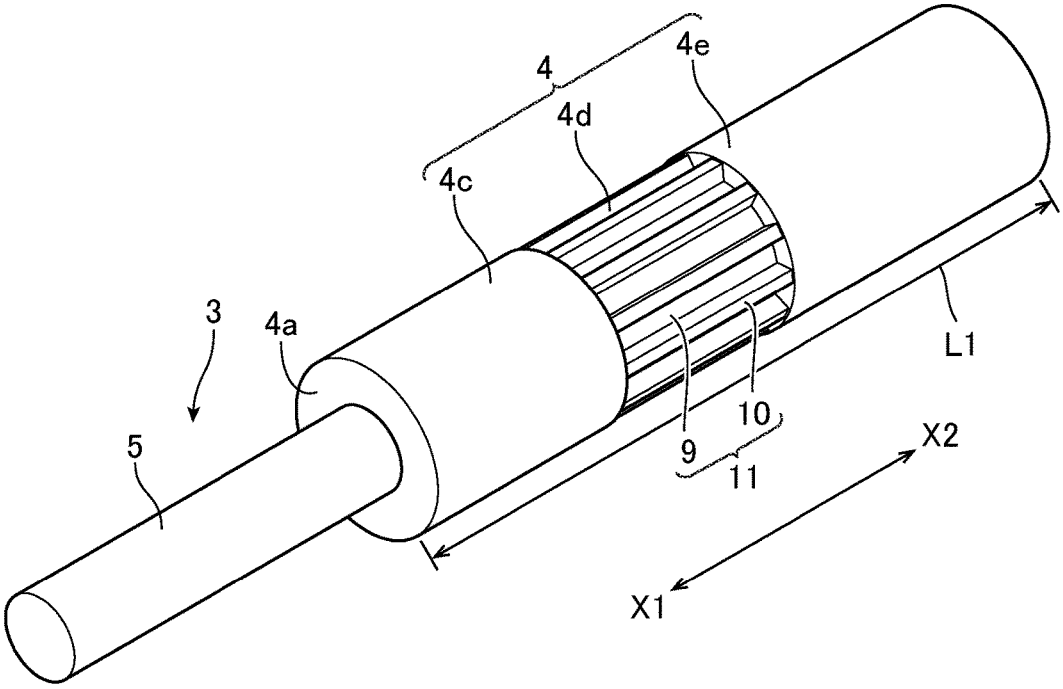
FIG. 3 is a perspective view of a shaft member forming the cylinder device according to the present embodiment.

As shown in FIG. 3, the shaft member 3 of the present embodiment includes a piston 4 formed with a predetermined diameter and having a predetermined length dimension L1 in the shaft direction (X1-X2 direction) and a piston rod 5 provided at a front end surface 4*a* of the piston 4 and having a diameter smaller than that of the piston 4.

As shown in FIGS. 2 and 4, the piston 4 and the piston rod 5 are preferably formed integrally with each other. As shown in FIG. 4, the piston 4 and the piston rod 5 have the shaft center O aligned on a straight line.

As shown in FIGS. 2 and 4, a hole 8 is formed at a rear end surface 4*b* of the piston 4 along the shaft center O in a direction of the piston rod 5.

As shown in FIG. 3, the piston 4 includes a front part 4*c*, an intermediate part 4*d*, and a rear part 4*e*, and the intermediate part 4*d* forms a rotating portion (gear portion) 11 in which recessed parts 9 and projecting parts 10 are alternately continuous along an outer circumferential surface. Here, the term "intermediate" indicates a position between a front side and a rear side and does not mean a center.

The recessed parts 9 and the projecting parts 10 forming the rotating portion 11 are formed at regular intervals in a circumferential direction. Further, the recessed parts 9 and projecting parts 10 are formed with a predetermined width in the shaft direction (X1-X2 direction). Each of the recessed part 9 and the projecting part 10 has a width larger than a diameter of each of rotation ports 31 and 32 which will be described below. In the configuration in which the shaft member 3 strokes as in the present embodiment, a width of the rotating portion 11 in the shaft direction is set according to the stroke amount of the shaft member 3.

Unlike the intermediate part 4*d*, the front part 4*c* and the rear part 4*e* of the piston 4 are formed in a columnar shape. Thereby, air bearings 21 to 23, which will be described below, are disposed on the front part 4*c* and the rear part 4*e*, and the piston 4 can stably float in the cylinder body 2.

The cylinder device 1 of the present embodiment is configured in which a fluid acts on the rotating portion 11 disposed on the outer circumferential surface around the shaft member 3 and thus the shaft member 3 can rotate about the shaft center O which is a center of rotation.

A cylinder chamber 12 is provided inside the cylinder body 2. Further, an insertion portion 13 is provided which penetrates from the cylinder chamber 12 to a front end surface 2*a* of the cylinder body 2 and is continuous with the cylinder chamber 12.

As shown in FIGS. 2 and 4, the piston 4 of the shaft member 3 is housed in the cylinder chamber 12. Further, the piston rod 5 of the shaft member 3 is inserted into the insertion portion 13.

The cylinder chamber 12 is a substantially cylindrical space having a diameter slightly larger than the diameter of the piston 4. Further, the cylinder chamber 12 is formed to have a length dimension in the X1-X2 direction longer than the length dimension L1 of the piston 4. Therefore, the piston 4 is movably housed in the cylinder chamber 12 in the shaft direction (X1-X2 direction).

In the states of FIGS. 2 and 4, the piston 4 is housed near a center of the cylinder chamber 12 in the X1-X2 direction. For this reason, spaces are provided on the front side (X1 side) and on the rear side (X2 side) of the piston 4, respectively. Here, the space on the front side is referred to as a first fluid chamber 14, and the space on the rear side is referred to as a second fluid chamber 15. The first fluid chamber 14 and the second fluid chamber 15 are divided from each other and do not interfere with each other.

As shown in FIGS. 2 and 4, the cylinder body 2 is formed with stroke ports 25 and 26 communicating with the first fluid chamber 14 and the second fluid chamber 15.

Further, as shown in FIGS. 2 and 4, the cylinder body 2 is formed with the rotation ports 31 and 32 at positions between the stroke ports 25 and 26. The rotation ports 31 and 32 communicate with the rotating portion 11 of the shaft member 3.

The cylinder device 1 of the present embodiment is an air bearing-type cylinder device, and a plurality of air bearing spaces 16, 17, and 18 are provided between the shaft member 3 and an internal space of the cylinder body 2. As shown in FIG. 4, the first air bearing space 16 is formed at the position of the piston rod 5. The second air bearing space 17 is formed at the position of the front part 4*c* of the piston 4. The third air bearing space 18 is provided at the position of the rear part 4*e* of the piston 4.

As shown in FIGS. 2 and 4, an air bearing 21 is disposed in the first air bearing space 16 to surround an outer circumference of the piston rod 5. Further, an air bearing 22 is disposed in the second air bearing space 17 to surround an outer circumference of the front part 4*c* of the piston 4. In addition, an air bearing 23 is disposed in the third air bearing space 18 to surround an outer circumference of the rear part 4*e* of the piston 4.

Although not being limited, an example of each of the air bearings 21 to 23 can include an air bearing in which a porous material using sintered metal or carbon is formed in a ring shape or an orifice throttle-type air bearing.

As shown in FIGS. 2 and 4, the cylinder body 2 is provided with air bearing pressurizing ports 27, 28, and 29 that communicate with the air bearing spaces 16, 17, and 18, respectively, from the outer circumferential surface of the cylinder body 2.

The compressed air is supplied to each of the air bearing pressurizing ports 27 to 29, and thus the compressed air uniformly blows onto surfaces of the piston 4 and the piston rod 5 through the each of the air bearings 21 to 23. Thereby, each of the piston 4 and the piston rod 5 is supported in a state of floating in the cylinder chamber 12 and the insertion portion 13.

In the cylinder device 1 of the present embodiment, the compressed air is supplied and discharged from the rotation ports 31 and 32 facing the rotating portion 11 of the shaft member 3. Thus, the fluid acts on the rotating portion 11 to generate a rotational force, and the shaft member 3 can rotate about the shaft center O which is the center of rotation. In the present embodiment, the shaft member 3 can rotate in a state of floating in the cylinder body 2. Since the shaft member 3 and the cylinder body 2 are not in contact with each other, a rotational resistance can be reduced and the rotation can be made with high accuracy.

The rotation port 31 shown in FIG. 4 is, for example, a supply port for compressed air, and the rotation port 32 is an exhaust port for compressed air. In FIG. 4, the respective rotation ports 31 and 32 are disposed on opposite sides through the rotating portion 11, but the preferred form of the rotation ports 31 and 32 will be described below. Thereby, it is possible to guide the compressed air from a supply position of the rotation port 31 to the rotation port 32 on the surface of the rotating portion 11 and to reduce the loss of the compressed air.

In the present embodiment, the piston 4 of the shaft member 3 is supported in the state of floating in the cylinder chamber 12 of the cylinder body 2 by the air bearing-type configuration, and accordingly minute gaps 30 are formed between the rotation ports 31 and 32 and the rotating portion 11 as shown in FIG. 4. Thereby, an air flow is formed while the compressed air passes through the gap 30, and the rotating portion 11 can efficiently rotate. In the present embodiment, since the piston 4 of the shaft member 3 is in the floating state during the rotation and the entire shaft member 3 rotates in a non-contact manner, rotation noise can be reduced.

In the present embodiment, a differential pressure between the first fluid chamber 14 and the second fluid chamber 15 is generated using a supply and discharge of the compressed air from the stroke ports 25 and 26 communicating with the cylinder chamber 12 in the state where the shaft member 3 floats in the cylinder body 2. Thereby, the piston 4 can be stroked in the shaft direction (X1-X2 direction). Although not shown, a cylinder control pressure can be appropriately adjusted by servo valves that communicate with the stroke ports 25 and 26, respectively.

Figure 5:
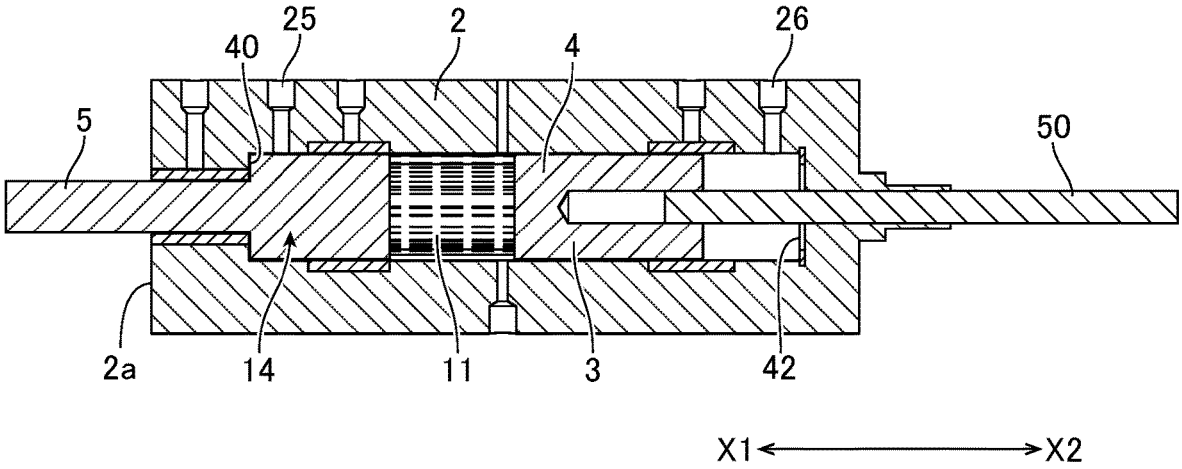
FIG. 5 is a cross-sectional view showing a state where a shaft member is stroked forward from the state of FIG. 2.

From the states of FIGS. 2 and 4, the compressed air in the first fluid chamber 14 is sucked through the stroke port 25 by the servo valve. On the other hand, the compressed air is supplied into the second fluid chamber 15 through the stroke port 26 by the servo valve. Thus, the differential pressure is generated between the first fluid chamber 14 and the second fluid chamber 15, and the piston 4 can move to the front side (X1) as shown in FIG. 5. Thus, the piston rod 5 can be protruded forward from the front end surface 2*a* of the cylinder body 2.

A front wall 40 is provided between the cylinder chamber 12 and the insertion portion 13, and the piston 4 is regulated so as not to move forward from the front wall 40. Further, as shown in FIG. 4, the front wall 40 is preferably provided with an elastic ring 41. The elastic ring 41 acts as a buffer material when the piston 4 comes into contact with the front wall 40.

Figure 6:
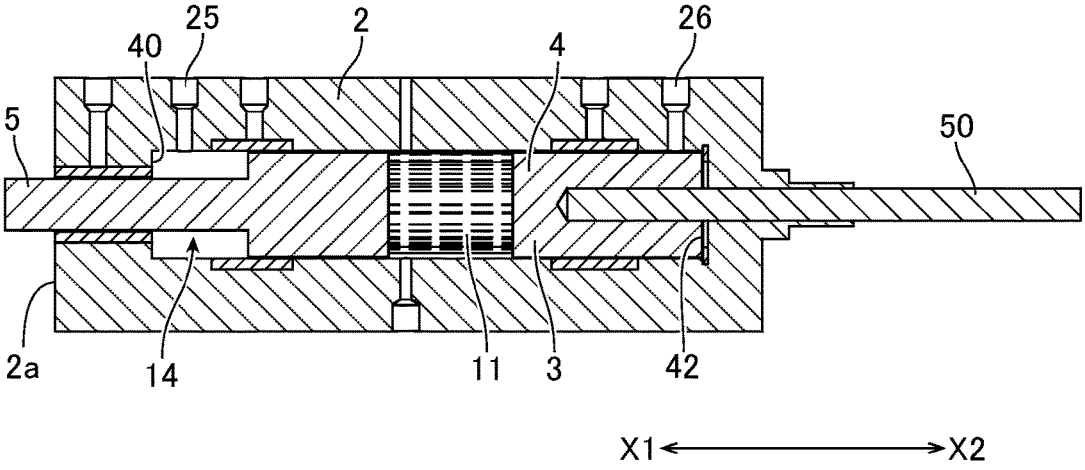
FIG. 6 is a cross-sectional view showing a state where the shaft member is stroked rearward from the state of FIG. 2.

Alternatively, from the states of FIGS. 2 and 4, the compressed air in the second fluid chamber 15 is sucked through the stroke port 26 by the servo valve. On the other hand, the compressed air is supplied into the first fluid chamber 14 through the stroke port 25 by the servo valve. Thus, the differential pressure is generated between the first fluid chamber 14 and the second fluid chamber 15, and the piston 4 can move to the rear side (X2) as shown in FIG. 6. Thus, the piston rod 5 can be retracted rearward from the front end surface 2*a* of the cylinder body 2.

A rear wall 42 of the cylinder chamber 12 is a regulatory surface that regulates the movement of the piston 4 to the rear side (X2), and the piston 4 can hardly move rearward from the rear wall 42. Further, as shown in FIG. 4, the rear wall 42 is preferably provided with an elastic ring 43. The elastic ring 43 acts as a buffer material when the piston 4 comes into contact with the rear wall 42.

As shown in FIGS. 1, 2, and 4, and the like, a sensor (stroke sensor) 50 is provided in the hole 8 formed in the rear end surface 4*b* of the piston 4 in a non-contact manner with the piston 4. The sensor 50 is fixedly supported on the rear end side of the cylinder body 2.

In the present embodiment, a position of the piston 4 can be measured by the sensor 50 disposed in the hole 8. An example of the sensor 50 can include an existing sensor such as a magnetic sensor, an eddy-current sensor, or an optical sensor.

Position information measured by the sensor 50 is transmitted to a control unit (not shown) through a cable 51 (see FIG. 4). Based on the position information measured by the sensor 50, the cylinder control pressures of the first fluid chamber 14 and the second fluid chamber 15 can be adjusted to control the amount of protrusion of the piston rod 5.

Further, the sensor 50 can also measure a rotational frequency of the shaft member 3. Based on rotation information measured by the sensor 50, a rotation pressure can be adjusted to control a rotational frequency of the rotating portion 11.

Hereinafter, a description will be made with respect to the form of the rotation ports 31 and 32 for facilitating the rotation of the rotating portion 11. All the drawings described below are partial cross-sectional views taken in a direction orthogonal to the shaft direction (X1-X2 direction).

Figure 7:
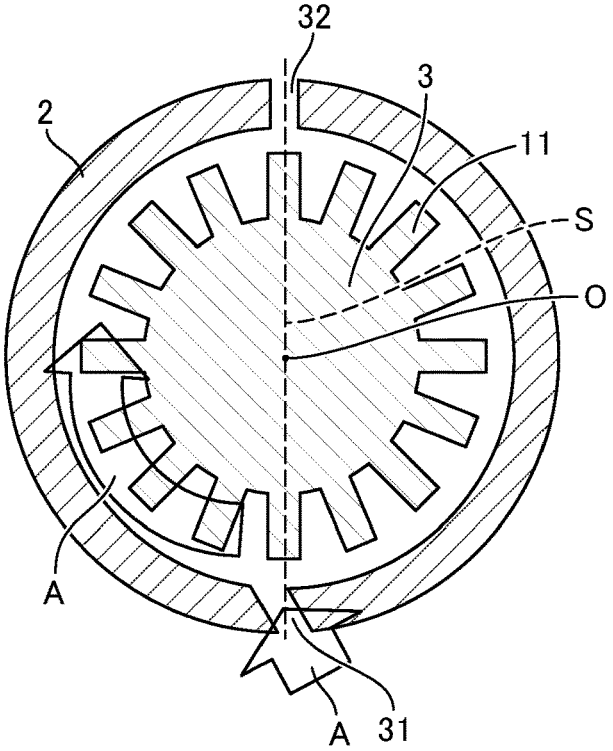
FIG. 7 is a cross-sectional view of the cylinder device according to the present embodiment taken along a direction orthogonal to the shaft direction.

For example, as shown in FIG. 7, the rotation port 31 and the rotation port 32 are provided on opposite sides through the shaft member 3, but it is preferable that one or both of the rotation ports 31 and 32 be changed in angle such that penetration directions of the respective rotation ports 31 and 32 are not aligned in a straight line through the shaft center O of the shaft member 3. In FIG. 7, the penetration direction of the rotation port 31 is provided to be inclined from a straight direction S passing through the shaft center O. An arrow A indicates a direction of the flow of the compressed air, and the compressed air enters the cylinder body 2 diagonally from the rotation port 31 and easily flows in one side direction of the rotating portion 11. As a result, the rotating portion 11 can appropriately rotate.

Figure 8:
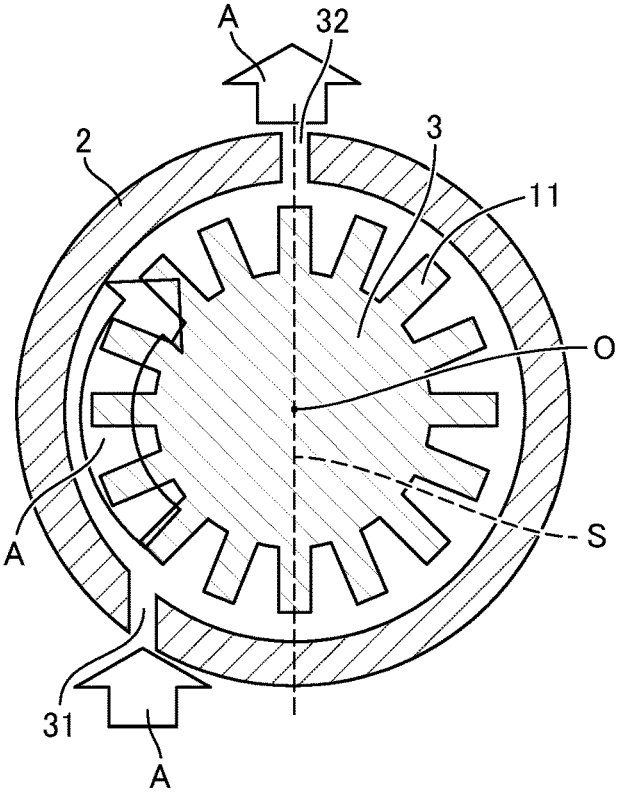
FIG. 8 is a cross-sectional view of a cylinder device different from that shown in FIG. 7.

In FIG. 8, the rotation port 31 is disposed at a position deviated from the straight direction S passing through the shaft center O. In other words, the rotation ports 31 and 32 are disposed to be shifted from each other without being aligned on a straight line passing through the shaft center O. At this time, the rotation port 31, which is the supply side, is preferably disposed to be shifted. Thus, the compressed air supplied from the rotation port 31 easily flows in one side direction of the rotating portion 11 as indicated by the arrow A. As a result, the rotating portion 11 can appropriately rotates.

Figure 9:
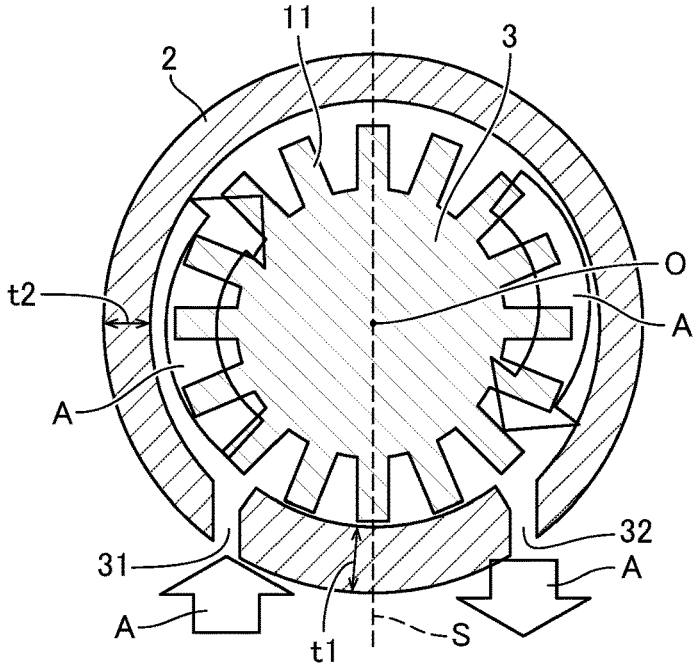
FIG. 9 is a cross-sectional view of a cylinder device different from that shown in FIG. 7.

The respective rotation ports 31 and 32 are disposed on the substantially opposite sides through the shaft member 3 in FIGS. 7 and 8, but the respective rotation ports 31 and 32 may be disposed on the same side as viewed from the shaft member 3 as shown in FIG. 9. As shown in FIG. 9, the respective rotation ports 31 and 32 may be preferably disposed to be shifted to left and right with respect to the straight direction S passing through the shaft center O. Thereby, as indicated by the arrow A, the compressed air supplied from the rotation port 31 flows in one side direction of the rotating portion 11, rotates more than a half of the circumference, and is discharged to the outside from the rotation port 32. In FIG. 9, since the respective rotation ports 31 and 32 are disposed at positions close to each other, in order to prevent the flow of the compressed air from occurring as much as possible at a short distance between the respective rotation ports 31 and 32, a body thickness t1 of the cylinder body 2 on a side of a short distance is preferably thicker than a body thickness t2 of the cylinder body 2 on a side of a long distance between the respective rotation ports 31 and 32. Thereby, a space between the cylinder body 2 and the rotating portion 11 can be made narrower at the position of the body thickness t1 compared with the position of the body thickness t2, and the compressed air can be controlled so as not to flow through the short distance between the respective rotation ports 31 and 32 as much as possible. Therefore, the compressed air supplied from the rotation port 31 can be discharged from the rotation port 32 by passing through the side of the long distance from the rotating portion 11. As a result, the rotating portion 11 can appropriately rotate.

Figure 10:
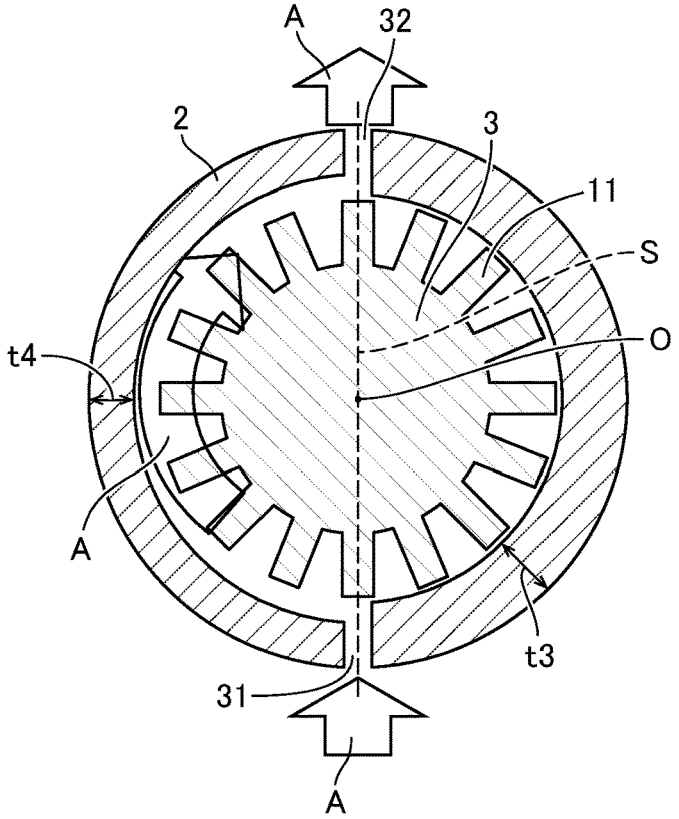
FIG. 10 is a cross-sectional view of a cylinder device different from that shown in FIG. 7.

In FIG. 10, the penetration directions of the rotation ports 31 and 32 is provided along the straight direction S passing through the shaft center O, but a body thickness t3 of the cylinder body 2 on one side of the rotation ports 31 and 32 is set to be thicker than a body thickness t4 of cylinder body 2 on the other side. Thereby, a space between the cylinder body 2 and the rotating portion 11 can be made narrower at the position of the body thickness t3 compared with the position of the body thickness t4, and the compressed air can be controlled so as not to flow through a portion of the body thickness t3 as much as possible. Therefore, the compressed air supplied from the rotation port 31 can easily flow to only one side where the space between the rotating portion 11 and the cylinder body 2 is wide as indicated by the arrow A, and as a result, the rotating portion 11 can appropriately rotate.

Features of the present embodiment will be described.

The present embodiment is to provide the cylinder device 1 including the cylinder body 2 and the shaft member 3 supported in the cylinder body 2, the cylinder body 2 being provided with the rotation ports 31 and 32 that communicate with the outer circumferential surface around the shaft member 3 and rotate the shaft member 3 based on the supply and discharge of the fluid.

In the present embodiment, as described above, the cylinder body 2 is provided with the rotation ports 31 and 32 communicating with the outer circumferential surface of the shaft member 3 such that the fluid acts on the outer circumferential surface of the shaft member 3 to rotate the shaft member 3. According to such a configuration, it is possible to reduce power consumption and achieve compactification as compared with the conventional configuration using a rotary motor such as a stepping motor or a servo motor.

In the present embodiment, prevention of rotation unevenness can be made. The "prevention of rotation unevenness" will be described in detail. In the present embodiment, the rotating portion 11 is configured on the outer circumferential surface of the shaft member 3 that coincides with the rotating direction. Therefore, the distances from the rotating portion 11 to the rotation ports 31 and 32 can always be substantially constant without being changed depending on the rotation of the rotating portion 11 or the stroke of the shaft member 3. For example, in a configuration in which the distances from the rotating portion to the rotation ports change depending on the stroke of the shaft member 3, a rotation pressure changes, resulting in uneven rotation. On the other hand, according to the present embodiment, since the distances from the rotating portion 11 to the rotation ports 31 and 32 can be kept substantially constant, the rotation pressure does not change and rotation unevenness can be prevented.

In the present embodiment, since the rotating portion 11 is configured on the outer circumferential surface of the shaft member 3 that coincides with the rotating direction, it is possible to prevent the generation of thrust in the shaft direction (X1-X2 direction) for the shaft member 3 based on the rotation of the rotating portion 11. Therefore, the shaft member 3 can be prevented from freely moving in the shaft direction or the stroke amount of the shaft member 3 can be prevented from being varied, so that no special means for controlling the stroke amount due to the rotation is required.

In the present embodiment, the shaft member 3 includes the rotating portion 11 in which the recessed parts 9 and the projecting parts 10 are alternately continuous with each other along the outer circumferential surface. Then, the rotation ports 31 and 32 are formed to communicate with the rotating portion 11. The rotation ports 31 and 32 preferably face the rotating portion 11.

With such a configuration, it is not necessary to provide the rotating portion 11 separately from the shaft member 3, and the rotating portion 11 can be formed in a simple shape. Accordingly, the cylinder device 1 can be made compact and manufacturing cost can be reduced.

In the present embodiment, the shaft member 3 is preferably supported to be capable of stroke. Thereby, the shaft member 3 can be stroked while rotating.

In the present embodiment, the shaft member 3 includes the rotating portion 11 on the outer circumferential surface in the middle in the shaft direction (X1-X2 direction). The stroke ports 25 and 26 are provided in the cylinder body 2 on the front side (X1 side) and the rear side (X2 side) of the rotating portion 11 to stroke the shaft member 3 by the supply and discharge of the fluid. Then, the rotation ports 31 and 32 communicating with the rotating portion 11 are preferably provided between the stroke ports 25 and 26.

As described above, according to the present embodiment, since the rotating portion 11 is provided in the middle of the shaft member 3, a rotation mechanism needs not to be separately provided, and the device can be made compact. Further, the cylinder body 2 is provided with the rotation ports 31 and 32 communicating with the rotating portion 11, and the stroke ports 25 and 26 are provided in front of and behind the rotation ports 31 and 32. Thereby, it is possible to manufacture the cylinder device 1 in which the shaft member 3 can be stroked while rotating with a simple structure.

In the present embodiment, one rotation port may be provided. However, in such a case, the fluid is supplied and discharged by the one rotation port, and thus it is necessary to divide a supply time and a discharge time from each other, make the rotation port large or the like. In order to easily control the fluid and realize a smooth fluid flow, a plurality of rotation ports 31 and 32 are preferably provided.

In the present embodiment, the shaft member 3 preferably includes a fluid bearing, and the shaft member 3 is preferably supported in the state of floating in the cylinder body 2. Thereby, the stroke and rotation can be performed with high accuracy. The air bearing is preferably used as the fluid bearing. Thus, sliding resistance during the stroke and rotation can be effectively reduced.

The present invention is not limited to the above embodiment, and can be modified in various ways. In the above embodiment, the size and shape shown in the accompanying drawings can be appropriately changed within the range, in which the effects of the present invention are exhibited, without limitation. In addition, the above embodiment can be appropriately modified and implemented without deviating from the scope of the object of the present invention.

For example, the sensor 50 is not disposed as shown in FIGS. 2 and 4, and the like, and the sensor 50 may be disposed such that the position of the piston rod 5 can be directly measured.

However, as shown in FIGS. 2 and 4, and the like, when the sensor 50 is disposed in the hole 8 formed at the rear end surface 4*b* of the piston 4, the sensor 50 can be disposed, without any difficulty, on the piston 4 in a non-contact manner, compactification can be promoted, and the accuracy of position and rotation measurement can be improved.

The cylinder body 2 may be formed in such a manner that a plurality of divided cylinder bodies are assembled or integrated.

The cylinder body 2 and the shaft member 3 are made of, for example, an aluminum alloy and the like, but the material can be variously changed depending on the intended use, installation locations and the like without limitation.

As described above, according to the present embodiment, since the cylinder device 1 can be driven by the action of a fluid other than air, for example, a hydraulic cylinder can be exemplified in addition to the air bearing-type cylinder, as the cylinder device.

According to the present invention, it is possible to realize a cylinder device capable of preventing rotation unevenness while reducing power consumption and promoting compactification. The present invention may be either of a cylinder device capable of only rotation or a cylinder device capable of both rotation and stroke. According to the present invention, it is possible to obtain excellent rotation accuracy and rotational stroke accuracy. In this way, when the cylinder device of the present invention is applied to a use that requires high rotational accuracy and rotational stroke accuracy or the like, it is possible to reduce power consumption and promote compactification in addition to high accuracy.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A cylinder device comprising:

a cylinder body; and a shaft member supported in the cylinder body, wherein the cylinder body is provided with rotation ports that communicate with an outer circumferential surface around the shaft member and rotate the shaft member based on a supply and discharge of a fluid, wherein the rotation ports comprise a supply port for supplying the fluid, and an exhaust port for discharging the fluid, wherein the supply port and the exhaust port are communicably connected to each other around the shaft member within the cylinder body, wherein the shaft member is supported to be capable of stroke movement between a front end and a rear end of the cylinder body, wherein the shaft member includes a rotatably driven portion on the outer circumferential surface in a midportion of the shaft member, wherein stroke ports are provided in the cylinder body at the front end and the rear end to stroke the shaft member together with the rotatably driven portion by the supply and discharge of fluid through the stroke ports, and wherein the rotation ports, communicating with the rotatably driven portion, are provided between the stroke ports.

2. The cylinder device according to claim 1, wherein the rotatably driven portion comprises recessed parts and projecting parts that are alternately continuous with each other along the outer circumferential surface, and the rotation ports communicate with the rotatably driven portion.

3. The cylinder device according to claim 1, wherein the shaft member includes a fluid bearing, the shaft member being supported in a state of floating in the cylinder body.

* * * * *